US006540623B2

(12) United States Patent
Jackson

(10) Patent No.: US 6,540,623 B2
(45) Date of Patent: Apr. 1, 2003

(54) COMPOSITE SHAFT FOR A GOLF CLUB

(76) Inventor: Al Jackson, 2590 Pioneer Ave., Vista, CA (US) 92083

( * ) Notice: Subject to any disclaimer, the term of this patent is extended or adjusted under 35 U.S.C. 154(b) by 0 days.

(21) Appl. No.: 09/796,419

(22) Filed: Feb. 28, 2001

(65) Prior Publication Data

US 2002/0119830 A1 Aug. 29, 2002

Related U.S. Application Data

(60) Provisional application No. 60/232,367, filed on Sep. 14, 2000.

(51) Int. Cl.[7] ..... A63B 53/10
(52) U.S. Cl. ..... 473/319; 428/36.9
(58) Field of Search ..... 473/316–323; 428/36.3, 36.9; 264/635; 156/187–188

(56) References Cited

U.S. PATENT DOCUMENTS

| | | | |
|---|---|---|---|
| 1,581,647 | A | 4/1926 | Layton |
| 1,643,573 | A | 9/1927 | Boyden |
| 3,003,275 | A | 10/1961 | Reid |
| 3,614,101 | A | 10/1971 | Hunter |
| 3,809,403 | A | 5/1974 | Hunter |
| 3,907,446 | A | 9/1975 | Leslie |
| 3,941,390 | A | 3/1976 | Hussey |
| 4,082,277 | A | 4/1978 | Van Auken et al. |
| 4,132,579 | A | 1/1979 | Van Auken |
| 4,135,035 | A | 1/1979 | Branen et al. |
| 4,157,181 | A | 6/1979 | Cecka |
| 4,455,022 | A | 6/1984 | Wright |
| 4,591,157 | A | 5/1986 | Parente et al. |
| 4,757,997 | A | 7/1988 | Roy |
| 4,884,808 | A | 12/1989 | Retzer |
| 4,889,575 | A | 12/1989 | Roy |
| 5,018,735 | A | 5/1991 | Meredith et al. |
| RE33,735 | E | 11/1991 | Rumble et al. |
| 5,088,735 | A | 2/1992 | Shigetoh |
| 5,093,162 | A | 3/1992 | Fenton et al. |
| 5,245,779 | A | 9/1993 | Suzue et al. |
| 5,253,867 | A | 10/1993 | Gafner |
| 5,265,872 | A | 11/1993 | Tennent et al. |
| 5,308,062 | A | 5/1994 | Hogan |
| 5,316,299 | A | 5/1994 | Feche et al. |

(List continued on next page.)

FOREIGN PATENT DOCUMENTS

| | | |
|---|---|---|
| FR | 2673570 | 3/1991 |
| GB | 1446444 | 8/1976 |
| GB | 2202319 | 9/1988 |
| JP | 52-94368 | 8/1977 |
| JP | 55-25345 | 2/1980 |
| JP | 62-59030 | 3/1987 |
| JP | 4-68029 | 3/1992 |
| JP | 4-327925 | 11/1992 |

OTHER PUBLICATIONS

Letter of Dec. 24, 1996 describing asserted prior art.
Letter of Protest Pursuant to 37 C.F.R. § 1.291 (Dec. 23, 1996).
Advertisement from *Golf Shop Operations*, Jan. 1989.

*Primary Examiner*—Stephen Blau
(74) *Attorney, Agent, or Firm*—Kolisch Hartwell, P.C.

(57) ABSTRACT

A lightweight composite golf club shaft and method for its manufacture. The shaft preferably includes at least two biased plies extending approximately the length of the shaft and at least two longitudinal plies extending substantially less than the length of the shaft. The at least two biased plies contain fibers oriented at a substantial angle transverse to a longitudinal axis of the shaft. The at least two longitudinal plies contain fibers oriented approximately parallel to the longitudinal axis of the shaft. One of the at least two longitudinal plies aligns with the tip end of the shaft. One of the at least two longitudinal plies aligns with the butt end of the shaft. The at least two longitudinal plies at least partially overlap each other. The method for constructing such a shaft preferably includes rolling the plies onto a mandrel to form a rolled assembly where the plies are then fused together.

16 Claims, 6 Drawing Sheets

U.S. PATENT DOCUMENTS

| | | | | |
|---|---|---|---|---|
| 5,326,099 | A | | 7/1994 | Yamamoto et al. |
| 5,385,767 | A | | 1/1995 | Noguchi |
| 5,421,573 | A | | 6/1995 | Kawamatsu |
| 5,427,373 | A | | 6/1995 | Kusumoto |
| 5,451,058 | A | | 9/1995 | Price et al. |
| 5,511,779 | A | | 4/1996 | Meyers et al. |
| 5,538,769 | A | | 7/1996 | Sandman |
| 5,551,691 | A | | 9/1996 | Harada et al. |
| 5,788,585 | A | | 8/1998 | Jackson |
| 6,106,413 | A | * | 8/2000 | Kusumoto |

* cited by examiner

COMPOSITE SHAFT FOR A GOLF CLUB

CROSS-REFERENCE TO RELATED APPLICATIONS

This application claims priority from U.S. provisional patent application Ser. No. 60/232,367, entitled "Composite Shaft for a Golf Club," filed on Sep. 14, 2000.

BACKGROUND AND SUMMARY OF THE INVENTION

This present invention relates to lightweight golf club shafts. More particularly, it concerns an improved composite shaft, a method for its manufacture, and a club made with such a shaft. The invented golf shaft is a laminar structural element in the form of a spirally wound assembly of shaped planar sheets wrapped about a common axis.

The laminar structural element preferably includes several thin plies of pre-impregnated, continuous-fiber material. Preferably, two of the plies are similarly shaped and oriented with the fibers aligned with a particular bias, one of the plies with an approximate 45-degree angle transverse to the longitudinal axis of the laminar structural element and the other ply with an approximate 135-degree angle transverse to the longitudinal axis. A butt reinforcement ply, sandwiched between these two biased plies, has fibers aligned approximately perpendicular to the longitudinal axis. These three plies form a subassembly that is rolled first onto a mandrel that has the approximate shape of the desired golf shaft. Subsequently, at least two additional plies are cut in dissimilar shapes, both aligned in a nearly longitudinal or "zero" biased orientation and rolled onto the mandrel and subassembly.

The mandrel and wrapped plies then are baked in an autoclave to fuse the plies together to form the resulting shaft. The resulting lightweight shaft has been found to deliver excellent torque to a golf club head mounted on one end when the shaft is gripped and swung. It is believed that the resulting golf club can reduce the slice of the golf ball thereby greatly improving drive distance and accuracy achievable.

Various constructions of composite golf club shafts are disclosed in U.S. Pat. Nos. 1,226,444, 3,809,403, 4,082,277, 4,097,626, 4,132,579, 4,157,181, 4,757,997, 4,889,575, 5,088,735, 5,093,162, 5,245,779, 5,265,872, 5,316,299, 5,326,099, 5,385,767, 5,421,573, 5,427,373, and 5,551,691, the disclosures of which are all incorporated herein by reference. The use of carbon- or boron-based impregnated sheet material in a wrapped laminar structure that forms a thin-walled but very strong golf club shaft are described and illustrated in my U.S. Pat. Nos. 5,569,099 and 5,788,585, the disclosures of which also are incorporated herein by reference.

The advantages of the present invention will be understood more readily after a consideration of the figures and the detailed description.

DETAILED DESCRIPTION OF THE PREFERRED EMBODIMENT

Figure 1:
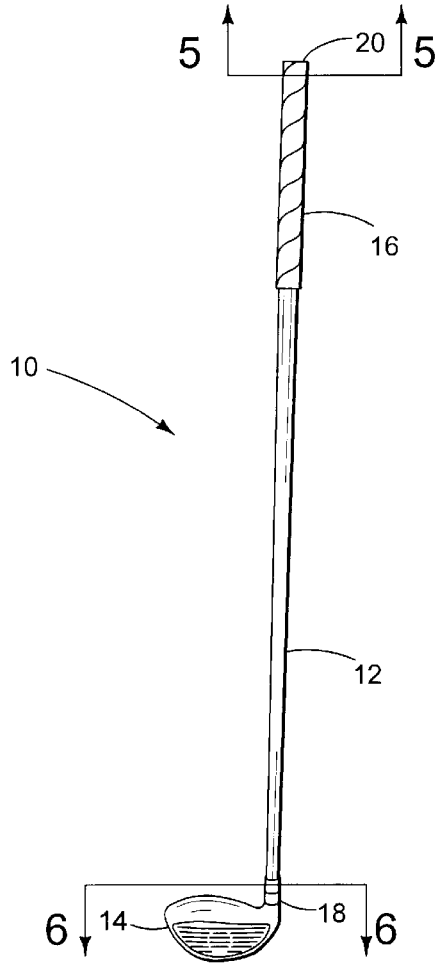
FIG. 1 is an isometric view of a typical golf club incorporating the invented shaft.

Referring to FIG. 1, a golf club according to one embodiment of the present invention is shown generally at 10. Golf club 10 typically includes a shaft 12, a head 14, and a grip 16. Golf club shaft 12 slightly flares from a tip end 18, adapted to attach head 14, to a butt end 20 over which grip 16 is placed. Preferably, shaft 12 is constructed from various laminar oriented fiber plies, as described in more detail below.

Figure 2:
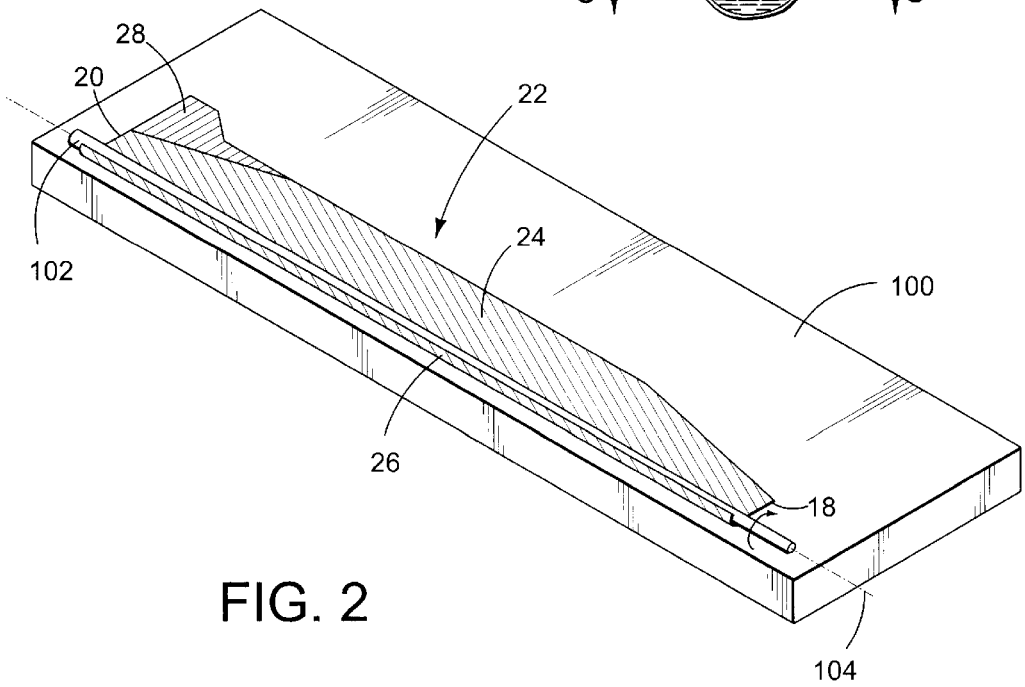
FIG. 2 is an isometric view illustrating how one embodiment of the golf club shaft of FIG. 1 may be manufactured. Specifically, it represents the beginning stage of rolling laminar plies onto a mandrel.

Referring now to FIG. 2, a subassembly of plies 22 formed with oriented fibers such as carbon, boron, composite, or metal is shown on a working surface 100. Plies 22 are given the desired slightly frustoconical shape of a golf club shaft by being rolled onto a mandrel 102, which effectively defines the inner contour of resulting shaft 12. Additional plies are subsequently positioned and rolled onto mandrel 102 on top of subassembly 22 to form a rolled assembly of plies. The rolled assembly of plies formed on mandrel 102 typically is heat-treated to cure and form resulting shaft 12.

Mandrel 102 has a tip end and a butt end that corresponds to tip end 18 and butt end 20 of shaft 12. When looking at tip end 18, subassembly 22 rolls onto mandrel 102 rotating in a clockwise direction about a longitudinal axis 104 of shaft 12, as shown in FIG. 2.

Figure 3:
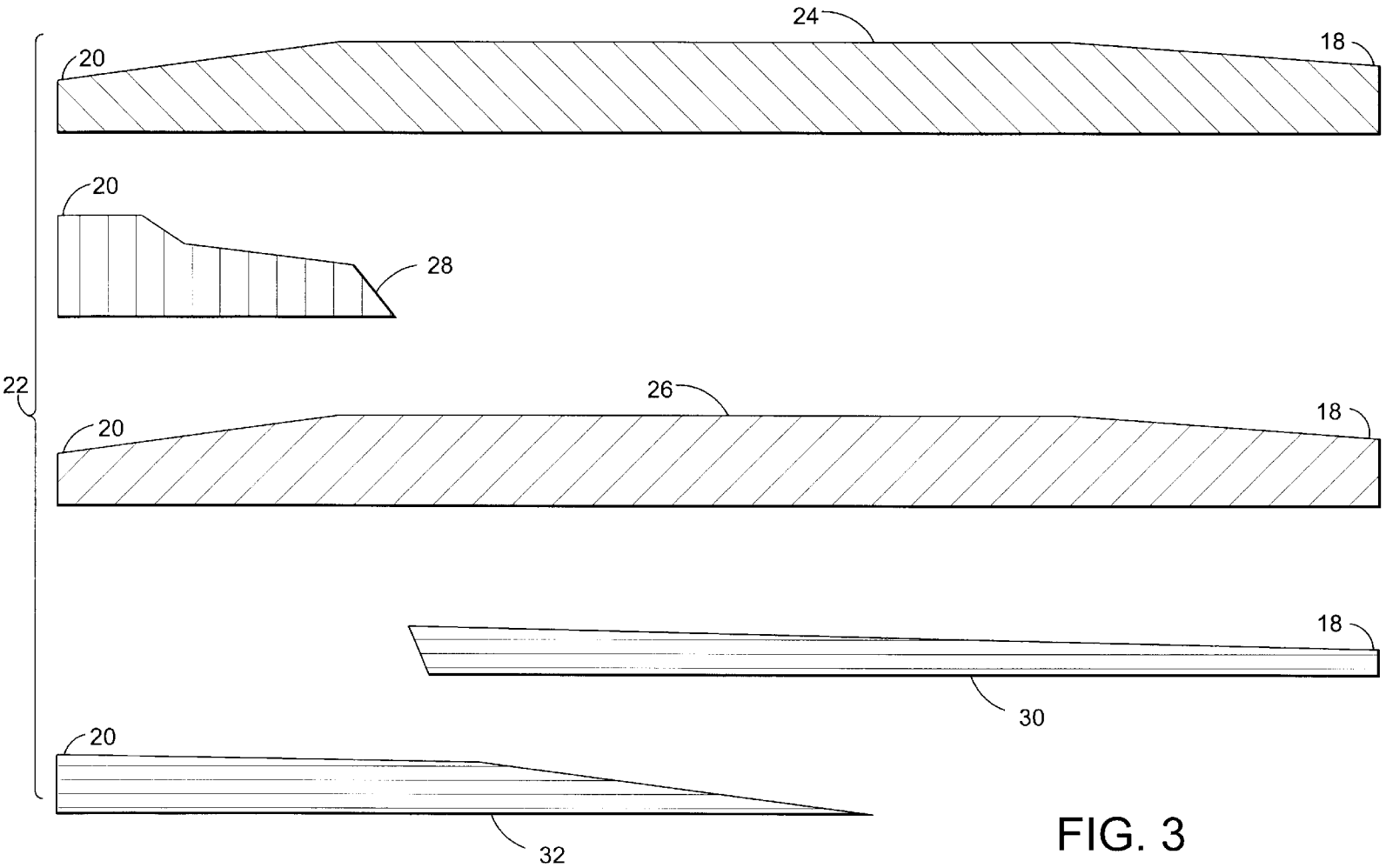
FIG. 3 is a plan view of laminar oriented fiber plies used in construction of the shaft shown in FIG. 2.

Referring now to FIG. 3, subassembly 22 is constructed of plies 24, 26, and 28, shown with their respective tip ends 18 and butt ends 20. Plies 24, 26, and 28 are made from pre-impregnated fibers oriented with a bias, referenced transverse to longitudinal axis 104, as shown. Preferably, ply 24 has an approximate 45-degree bias and ply 26 has an approximate 135-degree bias. Plies 24 and 26 extend an entire length of shaft 12, from tip end 18 to butt end 20. Sandwiched between plies 24 and 26, ply 28 preferably has a 90-degree bias and serves to reinforce butt end 20. Because of the fiber orientation of plies 24, 26, and 28 relative to longitudinal axis 104, these plies are referred to as biased plies.

Positioned on top of biased ply 26 and aligned with butt end 20 is butt reinforcement ply 28. The long edge of ply 28 is offset from a long edge of adjacent ply 26. The offset may vary, but typically ranges from ½–1¼ inches.

Biased ply 24 is placed on top of biased plies 26 and 28 and aligned with both tip end 18 and butt end 20. The long edge of biased ply 24 is generally not aligned with the long edge of biased ply 26. Preferably, the distance separating the edges of plies 24 and 26 at tip end 18 is approximately 3/16 of an inch and the distance separating the edges of plies 24 and 26 at butt end 20 is approximately ⅜ of an inch.

The construction of golf shaft 12 typically includes plies 30 and 32 in addition to subassembly 22. Plies 30 and 32 are substantially shorter in length than biased plies 24 and 26. Oriented with fibers approximately parallel to longitudinal axis 104, plies 30 and 32 generally are referred to as longitudinal plies. Longitudinal ply 30 aligns with tip end 18 and longitudinal ply 32 aligns with butt end 20. Longitudinal plies 30 and 32 overlap each other at least partially. Ply 32 typically is offset from plies 24, 26, and 30, which align with an initial position of rotation on mandrel 102. Instead, ply 32 aligns with a 180-degree position of rotation on mandrel 102.

The angle of the fibers of biased ply 24 may range from approximately 25-degrees to 65-degrees transverse to longitudinal axis 104, while the angle of the fibers of biased ply 26 may range from approximately 115-degrees to 155-degrees transverse to longitudinal axis 104. Generally, the fibers of ply 26 create a supplementary angle to the fiber angle of ply 24, with respect to longitudinal axis 104.

The angle of the fibers of butt reinforcement ply 28 may range from approximately 80-degrees to 100-degrees transverse to longitudinal axis 104. The angle of the fibers of longitudinal plies 30 and 32 generally range from approximately 10-degrees to −10-degrees transverse to longitudinal axis 104.

Figure 4:
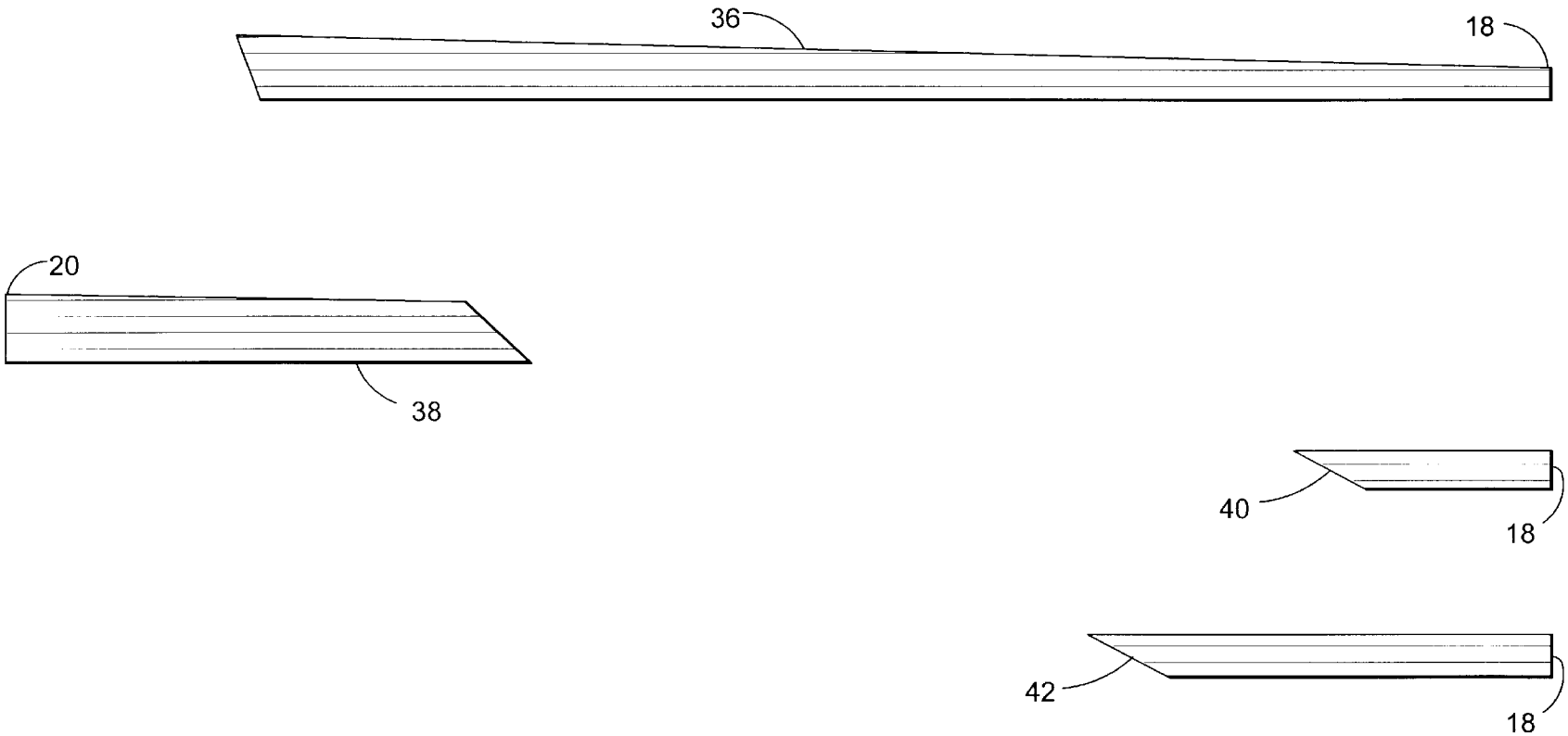
FIG. 4 is a plan view of additional laminar oriented fiber plies that may be used in construction of the shaft shown in FIGS. 2 and 3.

Referring to FIG. 4, an alternate embodiment of shaft 12 may include additional longitudinal plies such as plies 36 and 38 aligned with tip end 18 and/or butt end 20 of shaft 12. Typically these additional plies are aligned with the 180-degree position of rotation on mandrel 102, but can also be aligned with the initial position of rotation on mandrel 102.

Additional plies such as plies 40 and 42 may be used in the construction of shaft 12 as well. Plies of various fiber orientations from 0-degrees to 180-degrees, shapes, and/or sizes may be aligned with tip end 18 or butt end 20, or only for a middle portion of shaft 12. The additional plies may be aligned with the initial position of rotation or the 180-degree position of rotation on mandrel 102. The additional plies may further reinforce resulting shaft 12, or may be sacrificial layers that are sanded away during optional finishing steps of the manufacturing process.

Typically plies used in manufacturing shaft 12 are constructed of uniformly oriented pre-impregnated boron, carbon, composite, or metal fibers. The material of all of the component plies may vary among any variation of prepreg plies or reinforced plies. As a result, the thickness of the plies may vary slightly due to the ply material, type of fiber in the plies, etc.

Figure 5:
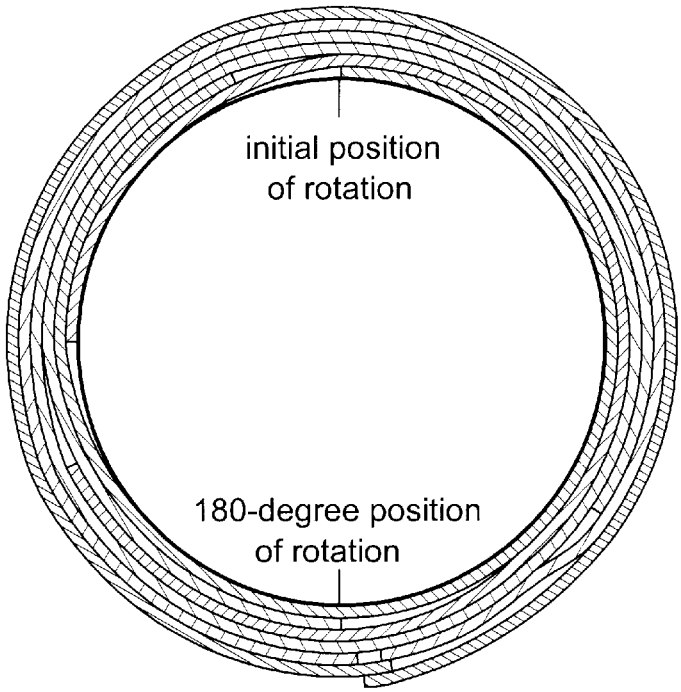
FIG. 5 is a greatly enlarged representative cross sectional view of an end of the shaft constructed using the plies shown in FIGS. 3–4, taken along line 5—5 in FIG. 1.
Figure 6:
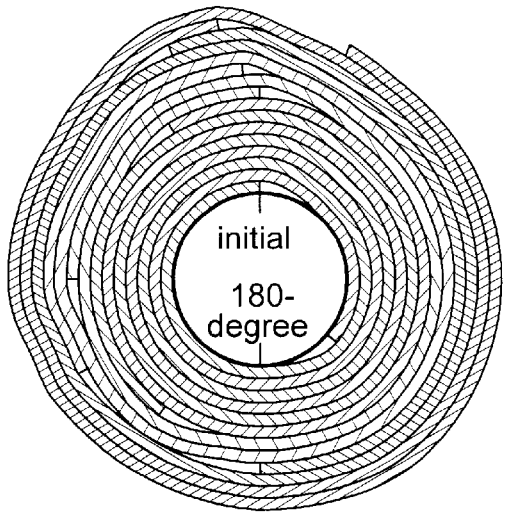
FIG. 6 is a greatly enlarged representative cross sectional view of another end of the shaft constructed using the plies shown in FIGS. 3–4, taken along line 6—6 in of FIG. 1.

Turning to FIGS. 5 and 6, FIG. 5 shows a cross-section of butt end 20 from the perspective of butt end 20 (taken along line 5—5 of FIG. 1) and FIG. 6 illustrates a cross-section of tip end 18 from the perspective of tip end 18 (taken along line 6—6 of FIG. 1), both cross-sections being exaggerated and representative. As seen from comparing the cross-sections, typical tip end 18 of shaft 12 has more spirally-wound wrappings of plies around mandrel 102 and contributes to a shaft thickness greater than the shaft thickness of butt end 20 of shaft 12. The number of resultant plies at each cross-section is a function of the position along shaft 12 at which the cross-section is taken.

Because biased plies 24 and 26 are rolled onto mandrel 102 first, biased plies 24 and 26 retain the contour of mandrel 102 and form the inner wall of shaft 12. Longitudinal plies or additional plies of shaft 12 typically define the outer surface of resulting shaft 12.

Figure 7:
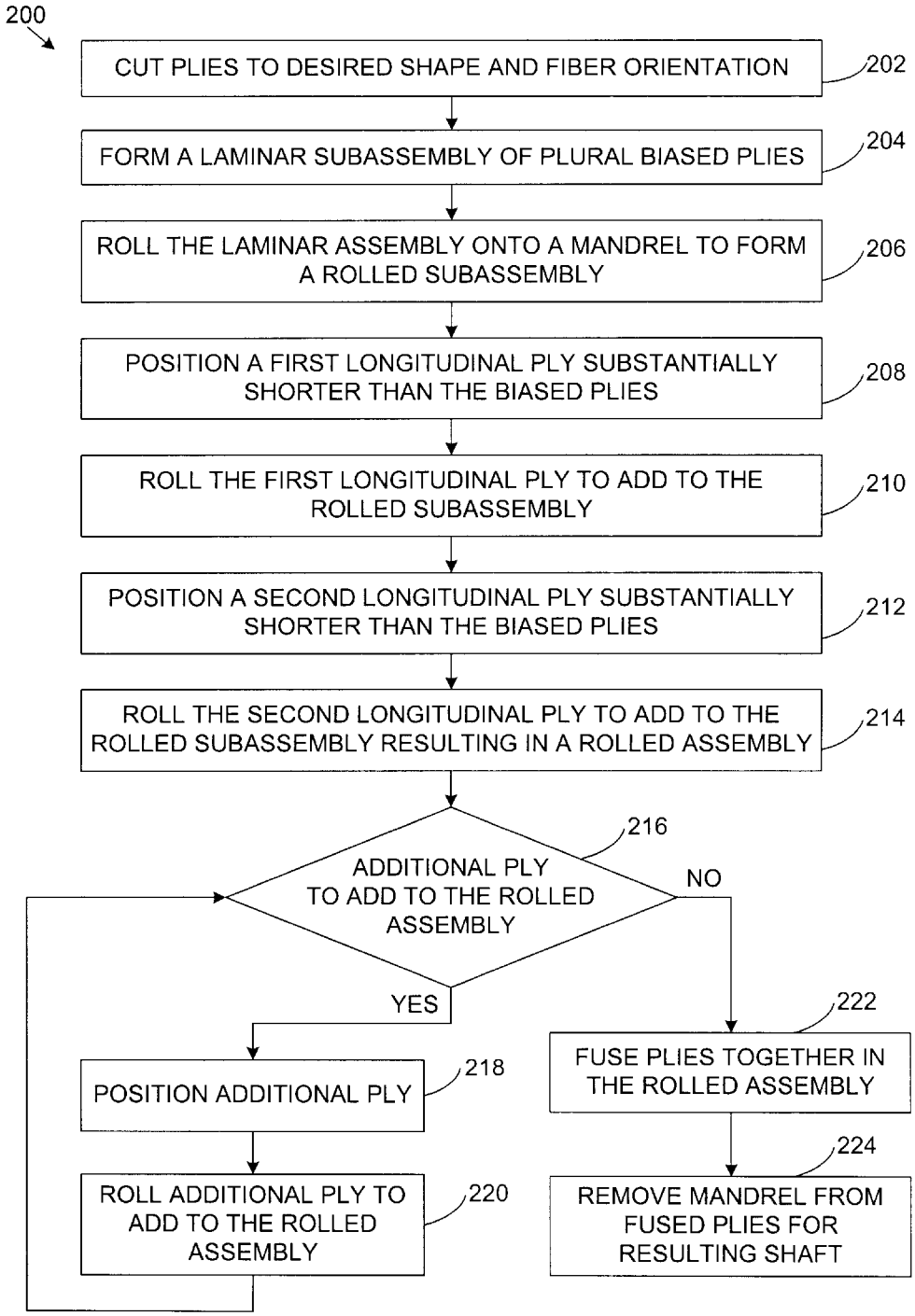
FIG. 7 is a flow chart of a method of manufacturing a shaft constructed using the plies shown in FIGS. 2–4.

Referring to FIG. 7, a method of constructing golf shaft 12 is shown generally at 200. Method 200 includes a step 202 of cutting plies, including biased plies 24, 26, and 28, longitudinal plies 30 and 32, and optional additional plies, into desired shapes with fibers oriented accordingly. At step 204, forming a laminar subassembly 22 of plural biased plies includes assembling and positioning biased plies 24, 26, and 28.

At step 206, laminar subassembly 22 is rolled onto mandrel 102 to form a rolled subassembly, previously shown in the beginning stage of rolling in FIG. 2. Typically, mandrel 102 is rolled clockwise when looking at tip end 18 as previously shown, but those of skill in the art would appreciate that mandrel 102 may be rolled in a reverse direction.

At step 208, positioning a first longitudinal ply 30 substantially shorter than biased plies 24 and 26 includes aligning longitudinal ply 30 with tip end 18 of shaft 12 and with the initial position of rotation on mandrel 102. Method 200 includes a step 210 of rolling longitudinal ply 30 to add to rolled subassembly 22.

To position a second longitudinal ply 32 substantially shorter than biased plies 24 and 26 at step 212, ply 32 is aligned with butt end 20 of shaft 12. At step 214, ply 32 is rolled onto and added to the rolled subassembly resulting in a rolled assembly.

At step 216, if there is an additional ply to be added to the rolled assembly, method 200 proceeds to step 218 where the additional ply is positioned. At step 220, method 200 includes rolling the additional ply to add to the rolled assembly and then returns to step 216.

If, at step 216, there are no additional plies to add to the rolled assembly, method 200 proceeds to step 222 where the plies in the rolled assembly fuse together to form shaft 12. Generally, the rolled assembly is cured in an autoclave, as will be understood by those having skill in the art, but may be cured under an alternative means by applying pressure, ultrasonic waves, or any combination of these.

Step 224 concludes the process by removing mandrel 102 from the cured rolled assembly of plies for resulting shaft 12. The upper plies on shaft 12 may be sanded and/or laminated to achieve a smooth surface on shaft 12, as mentioned above. Preferably, however, no such sanding is necessary, and the cured shaft is simply coated with paint or other finish.

Figure 8:
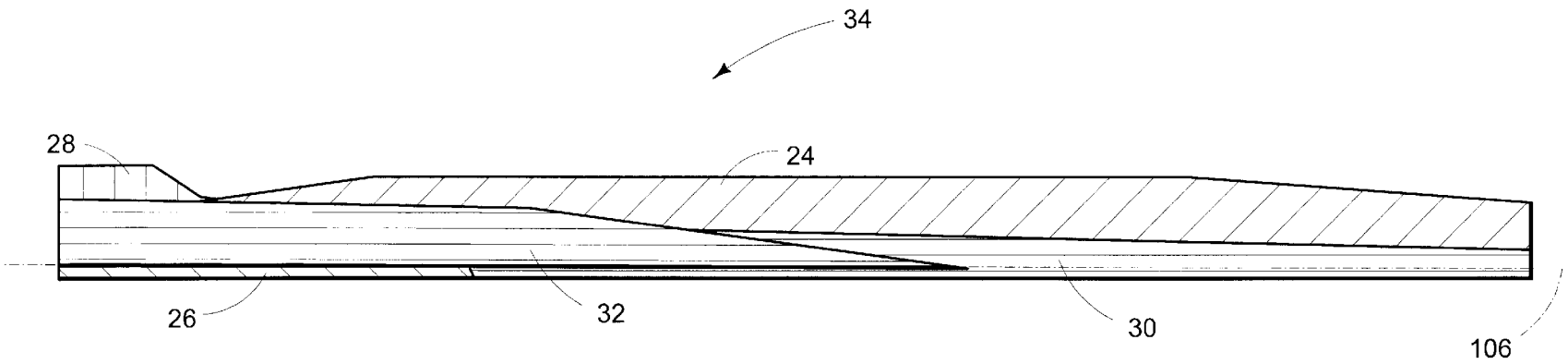
FIG. 8 is a plan view of the laminar oriented fiber plies of FIG. 3 positioned to make an assembly used in an alternate method of constructing the shaft. A dashed reference line is shown to represent a 180-degree position of rotation of the mandrel.

FIG. 8 shows an alternative method of constructing golf shaft 12 using the plies of FIG. 3. The method forms a laminar assembly 34 of plies before rolling the plies onto a mandrel 102. Assembly 34 begins with laminar subassembly 22, which is constructed as described above. Placed on top of biased ply 24 of subassembly 22, longitudinal ply 30 aligns with tip end 18 and a reference edge of subassembly 22 that generally corresponds to a long edge of ply 26 and/or an initial position of rotation on mandrel 102. Longitudinal ply 32 aligns with butt end 20 and with an imaginary reference line 106, as shown, that corresponds to a 180-degree position of rotation on mandrel 102, and partially overlaps plies 30 and 24, thereby forming assembly 34. Assembly 34 is rolled onto mandrel 102 to form a rolled assembly. Additional longitudinal plies as described above and in FIG. 4 may be rolled onto the rolled assembly. Similar to method 200, the plies of the rolled assembly fuse together and mandrel 102 is removed to form resulting shaft 12.

Those of skill in the art may appreciate that the order of placement of the plies may be switched or placed out of the order shown or described. For example, ply 24 may be in place for ply 26 and ply 26 may take the place of ply 24. Longitudinal plies 30 and 32 may also change order so that first longitudinal ply 30 is positioned and rolled after second longitudinal ply 32.

For optional added strength or reinforcement of shaft 12, additional biased plies similar to plies 24 and 26 and/or additional longitudinal plies similar to plies 30 and 32 may be added to shaft 12. Alternatively, to further conserve material and decrease the weight of shaft 12, butt reinforcement ply 28 is not necessary in the construction of shaft 12.

Although the invention has been disclosed in its preferred forms, the specific embodiments thereof as disclosed and illustrated herein are not to be considered in a limiting sense, because numerous variations are possible. The subject matter of the invention includes all novel and nonobvious combinations and subcombinations of the various elements, features, functions, and/or properties disclosed herein. No single feature, function, element or property of the disclosed embodiments is essential. The following claims define certain combinations and subcombinations of features, functions, elements, and/or properties that are regarded as novel and nonobvious. Other combinations and subcombinations may be claimed through amendment of the present claims or presentation of new claims in this or a related application. Such claims, whether they are broader, narrower, equal, or different in scope to any earlier claims, also are regarded as included within the subject matter of the invention.

I claim:

1. A golf club shaft having a length between a tip end and a butt end, comprising:

at least two biased plies extending approximately the length of the shaft; and at least two longitudinal plies extending substantially less than the length of the shaft, wherein:

the at least two biased plies contain fibers oriented at a substantial angle transverse to a longitudinal axis of the shaft;

the at least two longitudinal plies contain fibers oriented approximately parallel to the longitudinal axis of the shaft;

one of the at least two longitudinal plies aligns with the tip end of the shaft;

one of the at least two longitudinal plies aligns with the butt end of the shaft; and the at least two longitudinal plies at least partially overlap each other.

2. The shaft of claim 1, wherein the fibers are pre-impregnated.

3. The shaft of claim 1, wherein:

the fibers in one of the at least two biased plies are oriented at an angle within a range of approximately 25-degrees to 65-degrees transverse to the longitudinal axis; and the fibers in another of the at least two biased plies are oriented at an angle within a range of approximately 115-degrees to 155-degrees transverse to the longitudinal axis.

4. The shaft of claim 1, wherein the angles of the fibers in the at least two biased plies are supplementary with reference to the longitudinal axis.

5. The shaft of claim 1, wherein:

the fibers in one of the at least two biased plies are oriented at an angle of approximately 45-degrees transverse to the longitudinal axis; and the fibers in another of the at least two biased plies are oriented at an angle of approximately 135-degrees transverse to the longitudinal axis.

6. The shaft of claim 1, further comprising a butt end reinforcement ply approximately aligning with the butt end.

7. The shaft of claim 6, wherein the butt end reinforcement ply is sandwiched between the biased plies.

8. The shaft of claim 6, wherein the butt end reinforcement ply contains fibers oriented at an angle within a range of approximately 80-degrees to 100-degrees transverse to the longitudinal axis.

9. The shaft of claim 1, wherein:

one of the at least two longitudinal plies approximately aligns with an initial position of rotation on a mandrel; and another of the at least two longitudinal plies approximately aligns with a 180-degree position of rotation on the mandrel;

wherein the mandrel shares the longitudinal axis with the shaft.

10. The shaft of claim 1, further comprising an additional longitudinal ply, the additional longitudinal ply approximately aligning with the tip end or the butt end of the shaft.

11. The shaft of claim 1, further comprising an additional ply.

12. A golf club shaft, comprising:

two biased plies with pre-impregnated fibers oriented with a bias, the first biased ply with fibers oriented at an angle in the range of approximately 25-degrees to 65-degrees transverse to a longitudinal axis of the shaft and the second biased ply with fibers oriented at an angle in the range of approximately 115-degrees to 155-degrees transverse to the longitudinal axis, both biased plies extending approximately an entire length of the shaft;

two longitudinal plies with pre-impregnated fibers oriented approximately parallel to the longitudinal axis of the shaft, both longitudinal plies extending substantially less than the entire length of the shaft; and a butt end reinforcement ply; wherein:

one of the longitudinal plies aligns with a tip end of the shaft and another of the longitudinal plies aligns with a butt end of the shaft;

one of the longitudinal plies at least partially overlaps the other; and the butt end reinforcement ply aligns with the butt end of the shaft.

13. The shaft of claim 12, wherein the butt end reinforcement ply is sandwiched between the biased plies.

14. The shaft of claim 12, wherein the butt reinforcement ply contains fibers oriented approximately 80-degrees to 100-degrees transverse to the longitudinal axis.

15. The shaft of claim 12, further comprising an additional longitudinal ply that aligns with the tip end or the butt end of the shaft.

16. The shaft of claim 12, further comprising an additional ply.

* * * * *